US005737898A

United States Patent [19]

Grimm et al.

[11] Patent Number: 5,737,898

[45] Date of Patent: Apr. 14, 1998

[54] PACKAGING MACHINERY PRIMING TECHNOLOGY

[75] Inventors: Dennis C. Grimm; Mitch Lowe, both of Marietta, Ga.; Bruce D. Domino, Nisswa, Minn.

[73] Assignee: Riverwood International Corporation, Atlanta, Ga.

[21] Appl. No.: 415,492

[22] Filed: Apr. 3, 1995

[51] Int. Cl.[6] ..... B65B 21/00

[52] U.S. Cl. ..... 53/48.1; 53/147; 53/48.7; 53/48.8; 198/459.6; 198/463.4; 198/463.6

[58] Field of Search ..... 53/48.7, 48.8, 53/543, 209, 398, 147, 48.1; 198/459.6, 463.4, 463.6

[56] References Cited

U.S. PATENT DOCUMENTS

| | | | |
|---|---|---|---|
| 2,817,197 | 2/1957 | Anness | 53/48.8 |
| 3,108,414 | 10/1963 | Schleicher et al. | 53/48.8 |
| 3,225,510 | 12/1965 | Jones et al. | 53/48.8 |
| 3,509,684 | 5/1970 | Hohl et al. | 53/209 |
| 3,527,016 | 9/1970 | Doreau | 53/48.7 |
| 3,827,211 | 8/1974 | Zavatone et al. | 53/48.7 |
| 5,036,644 | 8/1991 | Lashyro et al. | 53/398 |
| 5,070,992 | 12/1991 | Bonkowski | 198/463.6 |

FOREIGN PATENT DOCUMENTS

| | | | |
|---|---|---|---|
| 543836 | 1/1956 | Belgium | 53/398 |

*Primary Examiner*—James F. Coan
*Assistant Examiner*—Gene L. Kim
*Attorney, Agent, or Firm*—Joel D. Skinner, Jr.; Steve M. McLary; Marvin L. Beekman

[57] ABSTRACT

An apparatus for controlling the input of articles at the start-up phase of a packaging machine of the type having at least one article conveyance lane and an article grouping mechanism constructed and arranged to meter articles moving in the conveyance lane into predetermined groups, comprising:

(a) at least one stop post aligned for extension into the conveyance lane, the stop post further being disposed at an infeed end of the article grouping mechanism;

(b) means to actuate the stop post, whereby the stop post is extendible and retractable in the article conveyance lane, the stop post impeding travel of articles in the lane when extended and permitting travel of articles in the lane when retracted; and (c) means to coordinate actuation of the means to actuate with operation of the article grouping mechanism.

1 Claim, 6 Drawing Sheets

PACKAGING MACHINERY PRIMING TECHNOLOGY

BACKGROUND OF THE INVENTION

1. Field of the Invention

This invention relates to packaging apparatus and methods. Particularly, this invention relates to an infeed control apparatus and method, for use with a packaging machine. The infeed control apparatus and method of the present invention are useful for controlling the startup or prime phase of a bottling machine or other packaging machine.

2. Background Information

In the past, various machines have been utilized to package a variety of product groups. Many of these machines operate continuously and at very high speeds once they are initially setup or configured. However, the initial start up of such machines is typically a slow process. Also, such machines must be periodically shut down for routine maintenance and cleaning, and in the event of a machine jam or other failure. Shut down may also occur to make changes in the processed product or packages. After a shut down and clean out of the remaining product, the machine must be setup once again prior to restarting. During setup, machines must be primed with an initial load of product at their infeed end. This initial priming of infeed product is typically performed by hand and is a relatively slow process. The initial start up, shut down and restart procedures significantly reduce the overall speed and productivity of the machine over the course of its operative life. And, because such procedures are labor intensive, they increase the overall cost of operating the machine.

Applicants' assignee manufactures a continuous motion cartoning machine having an auto-priming article infeed mechanism. The mechanism is the subject of a pending U.S. patent application. In so far as is known, no other apparatus or method has been developed or proposed which has solved the problem of accomplishing machine start up quickly, easily and automatically.

In view of the limitations and shortcomings of prior art, it is an object of this invention to provide an infeed mechanism for use with a continuous high speed packaging machine which minimizes setup time. Another object of this invention is to provide a mechanism which is fully adjustable for use with a variety of articles and article group types and sizes. A particular object of the invention is to provide an infeed mechanism which is self priming and automatically provides a full load of product at the infeed end so that the packaging machine is quickly setup and capable of being run at high speed.

SUMMARY OF THE INVENTION

In a basic aspect the present invention provides an apparatus for controlling the input of articles to a packaging machine having at least one article conveyance lane, comprising:

(a) at least one stop member aligned for extension into the conveyance lane; and (b) means to move the stop member, whereby the stop member is extendible and retractable in the article conveyance lane, the stop member impeding travel of articles in the lane when extended and permitting travel of articles in the lane when retracted.

In another aspect the invention provides an apparatus for controlling the input of articles at the start-up phase of a packaging machine of the type having at least one article conveyance lane and an article grouping mechanism constructed and arranged to meter articles moving in the conveyance lane into predetermined groups, comprising:

(a) at least one stop post aligned for extension into the conveyance lane, the stop post further being disclosed at an infeed end of the article grouping mechanism;

(b) means to actuate the stop post, whereby the stop post is extendible and retractable in the article conveyance lane, the stop post impeding travel of articles in the lane when extended and permitting travel of articles in the lane when retracted; and (c) means to coordinate actuation of the means to actuate with operation of the article grouping mechanism.

In yet another aspect, the invention provides an automatic priming packaging apparatus, comprising:

(a) a plurality of article conveyance lanes;

(b) an article grouping mechanism constructed and arranged to meter articles moving in the conveyance lanes into predetermined groups;

(c) at least one stop post aligned for extension into each the conveyance lane, the stop posts further being disposed at an infeed end of the article grouping mechanism;

(d) means to actuate the stop posts, whereby the stop posts are extendible and retractable in the article conveyance lane, the stop posts impeding travel of articles in the lanes when extended and permitting travel of articles in the lanes when retracted;

(e) means to coordinate actuation of the means to actuate and the article grouping mechanism; and (f) means to package article groups.

The benefits of this invention will become clear from the following description by reference to the drawings.

DESCRIPTION OF THE PREFERRED EMBODIMENT

Various packaging machines require priming with product prior to start up. For example, applicants' assignee, Riverwood International Corporation of Atlanta, Ga. manufactures the Autoflex™ machine which may be used to package beverage bottles in paperboard cartons. The present invention is disclosed in conjunction with an Autoflex machine.

U.S. Pat. No. 4,802,324 issued Feb. 7, 1989 to Everson, entitled Vertical Cartoning Assembly and Method, discloses an apparatus which is substantially identical to the Autoflex machine. U.S. Pat. No. 4,802,324 is incorporated by reference herein. Other packaging machinery which may utilize the apparatus of the present invention include the Marksman™ machine (disclosed in U.S. Pat. No. 5,036,644 issued Aug. 6, 1991 to Lashyro et al. and entitled Packaging Sleever Assembly, incorporated by reference herein) and the Charger™ machine.

The apparatus and method of the present invention are for controlling the input of articles at the infeed end of a high speed continuous motion packaging machine 10 such as the Autoflex Vertical Cartoner. The apparatus and methods improve the start-up of the machine 10.

Figure 2:
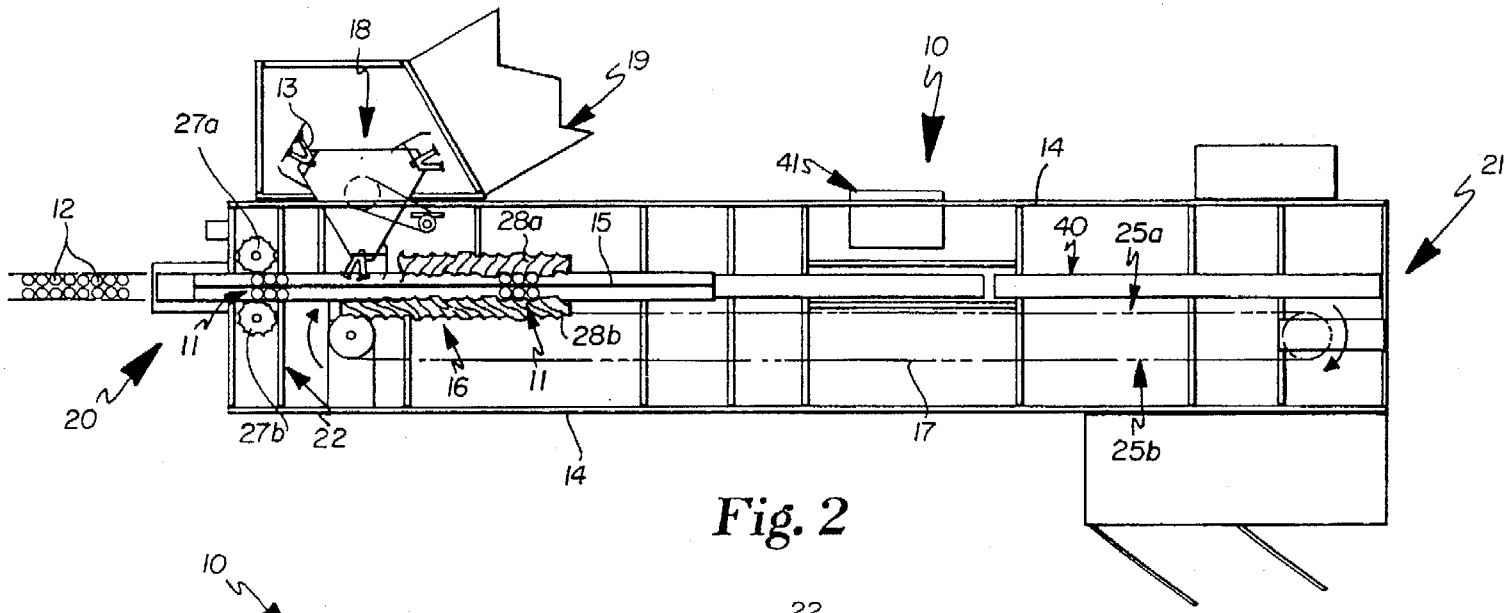
FIG. 2 is a top view of the apparatus shown in FIG. 1.
Figure 1:
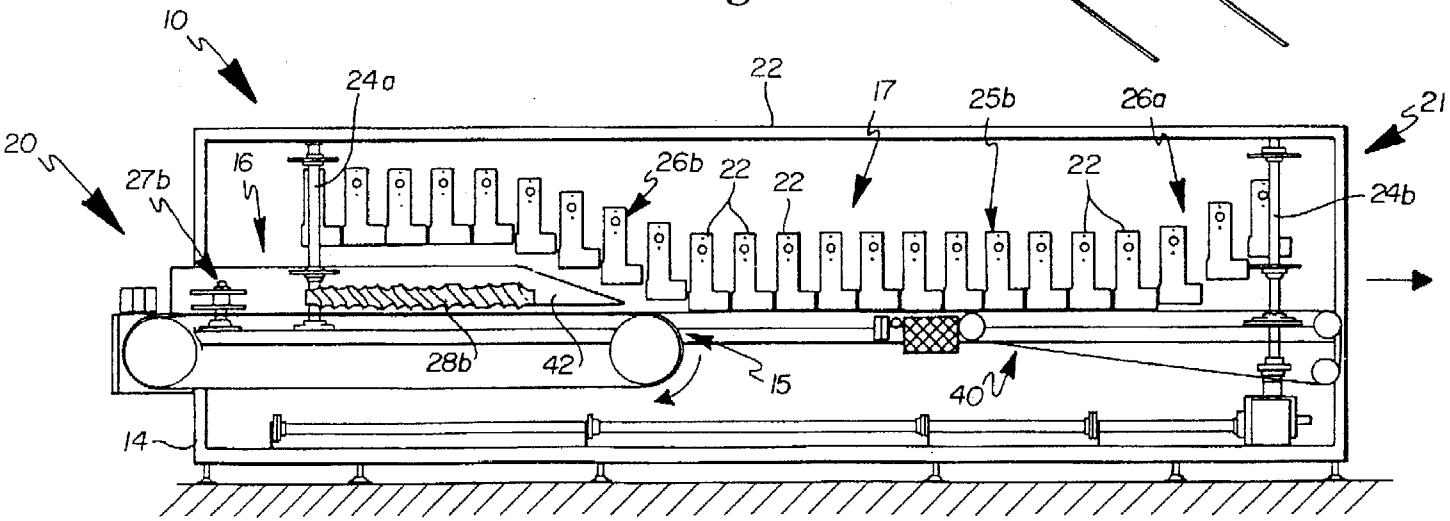
FIG. 1 is a side view of a vertical cartoning machine comprising the auto-priming mechanism of the present invention.
Figure 4:
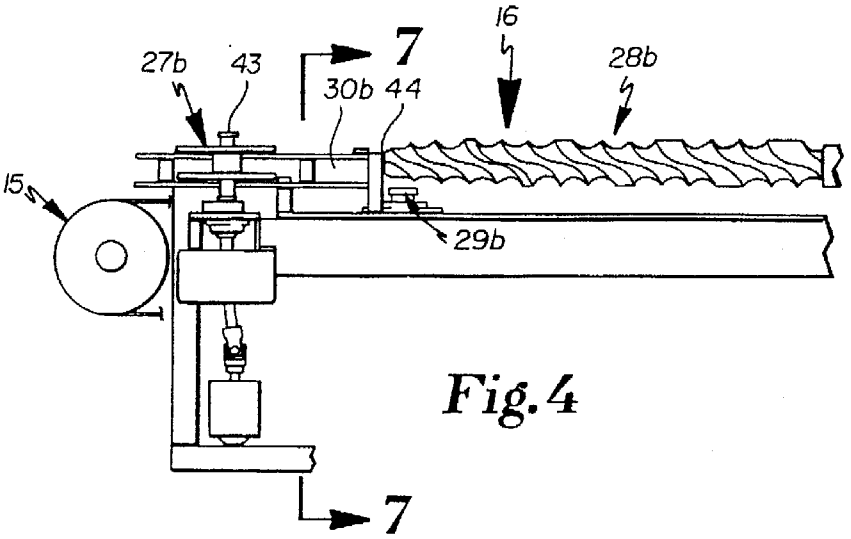
FIG. 4 is a side view of the infeed section of the apparatus shown in FIG. 1.
Figure 3:
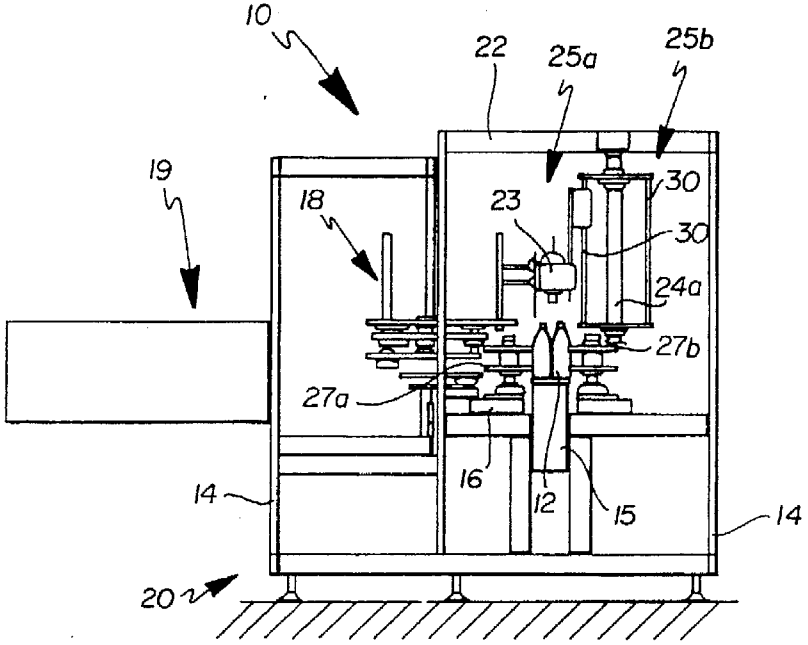
FIG. 3 is an end view of the apparatus.
Figure 11:
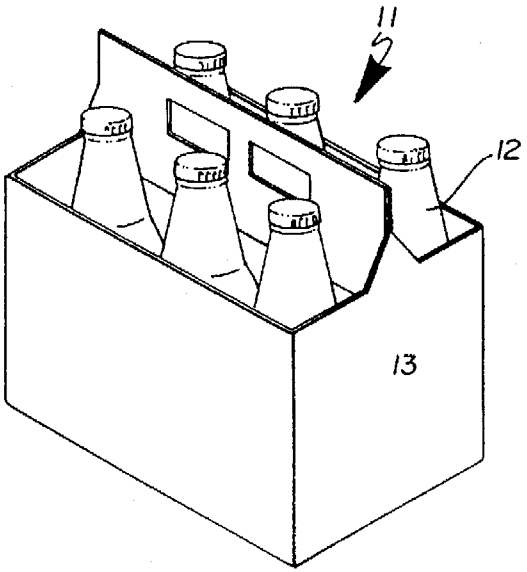
FIG. 11 is a perspective view of a filled carton produced by the vertical cartoner apparatus.
Figure 7:
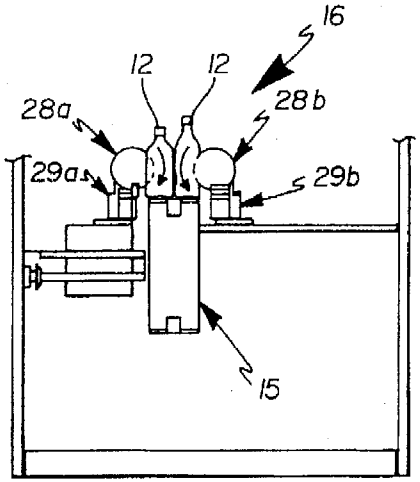
FIG. 7 is a crossectional view of the infeed section taken along line 7—7 of FIG. 4.
Figure 6:
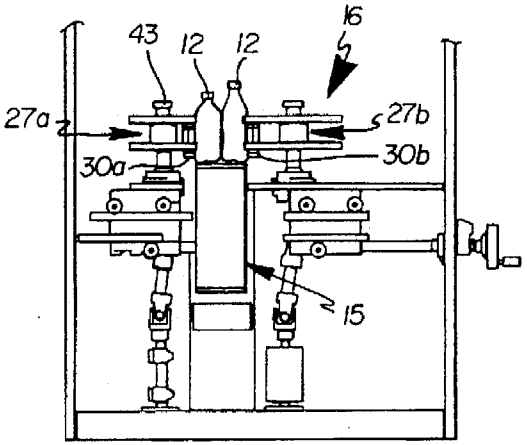
FIG. 6 is an end view of the infeed section.

Referring to FIGS. 1–3, the vertical cartoner 10, including the auto-priming system of the present invention, continuously packages product groups 11, for example six packs of beverage bottles 12, into cartons 13 by partially erecting the cartons, forming and linearly moving the product groups, and lowering the partially erected cartons 13 onto the groups which are disposed below. The vertical cartoner 10 produces completed cartoned product groups such as the group shown in FIG. 11.

The vertical cartoner 10 comprises a frame or base 14, a through-put conveyor 15, an infeed section 16 which includes the auto-priming system of the present invention, a cartoning carousel 17, a carton placer 18, a carton magazine 19 and a product group discharge conveyor 40. Product to be cartoned, for example the plastic beverage bottles 12, and paperboard cartons 13 are input at a first or infeed end 20. The bottles 12 and cartons 13 are conveyed longitudinally, downstream from the infeed end 20, are united as discussed further below, and are conveyed further downstream to a second or output end 21. The vertical cartoner 10 is adjustable to accommodate various sizes and types of products and product groups. The vertical cartoner 10 additionally comprises ancillary mechanisms such as drive mechanisms, carton folding mechanisms, gluing mechanisms. The cartoner 10 has a control panel 41 where the operation of the apparatus 10 is electronically monitored and controlled.

The through-put conveyor 15 is centrally aligned on the frame and extends a predetermined length at a predetermined height. In a six pack mode, the conveyor 15 has a width which will accommodate two bottles 12 side by side. The infeed end of the conveyor 15 preferably has a lane divider 42 of a predetermined, short length. The conveyor 15 is of a design which is well known in the art. The conveyor 15 moves at a predetermined first speed in a normal processing mode and at a predetermined slower second speed in a priming mode. The conveyor 15 preferably extends a predetermined distance downstream and ends where a discharge conveyor 40 conveys formed, filled cartons for discharge.

Figure 5:
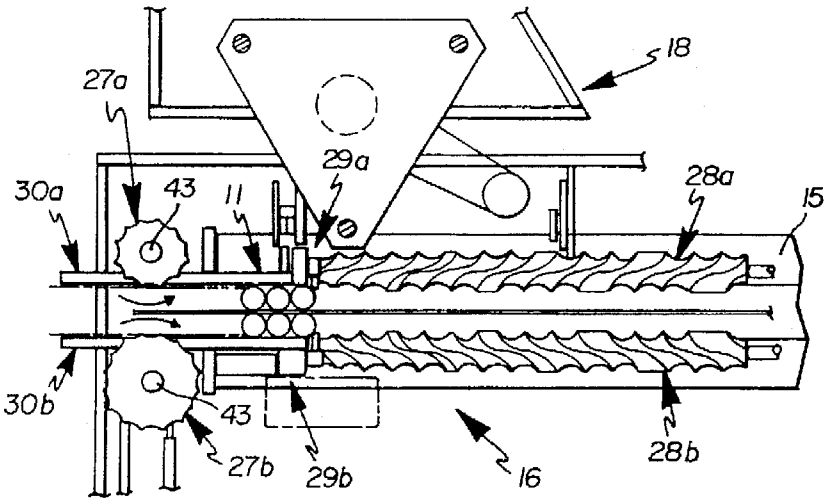
FIG. 5 is a top view of the infeed section.

The infeed section 16 accepts bottles 12 from ancillary infeed apparatus, meters the bottles 12 into a desired group size, in this example a 2×3 six pack, and spaces the groups with respect to other groups 11 and the bottles 12 within each group 11 with respect to each other. Referring also to FIGS. 7–12, the infeed section 16 comprises star wheels 27*a* and *b*, metering screws 28*a* and *b*, guide rails 30*a* and *b*, auto-priming bottle stops 29*a* and *b*, and control circuitry and software (not shown). The star wheels 27, metering screws 28, guide rails 30 and bottle stops 29 each consist of a pair of individual, identical elements (a and b, respectively). The individual elements of each pair are arranged on opposite sides of and adjacent the through-put conveyor 15. The guide rails 30 preferably have upper and lower members 31*a* and *b* vertically spaced apart a predetermined distance. The vertical and horizontal positions of the rail members 31 are preferably adjustable via adjustment mechanism 32 disposed on support 33. The starwheels 27 are disposed a predetermined distance downstream of the input end of the conveyor 15 and upstream of the metering screws 28. The inward portion of each star wheel 27 extends a predetermined distance over conveyor 15, through the guide rail members 31. The configuration of the starwheel 27 periphery may vary depending upon bottle or article size and configuration. The starwheels 27 rotate as shown in FIG. 5 about vertically oriented shafts 43 at a predetermined rate. Sensors (not shown) are communicatively coupled to the shafts 43 to sense their rotational position in a prime mode. The metering screws 28 have a predetermined length and dimension which is known in the art. The metering screws 28 are synchronized with and driven at the same speed as the starwheels 27, preferably by a common drive mechanism. Rotation of the metering screws 28 about shafts 44, as shown in FIG. 10, groups the bottles 12 and spaces the formed groups 11 a predetermined distance from each other. Sensors (not shown) are communicatively coupled to the sensor shafts to sense their rotational position in a prime mode. The function of these infeed section elements and their cooperation with the bottle stops 29 is discussed below.

The placer 18 is preferably a continuous motion rotary device which removes individual flat and folded carton 13 blanks from the storage magazine, and partially erects the blanks while transporting them to the cartoning carousel 17. At a predetermined point, the placer 18 transfers the blanks to the cartoning carousel 17. The placer 18 is disposed near the infeed end 20 of the apparatus 10 at a predetermined height above that of the through-put conveyor 15. The placer 18 rotates about a vertically disposed shaft.

The cartoning carousel 17 is a continuous motion mechanism which receives partially erected cartons 13 from the placer 18 and drops the cartons 13 onto the tops of the moving bottle groups 11 output by the metering screws 28 and traveling at a predetermined speed on the conveyor 15. The cartoning carousel 17 is synchronized with the placer 18 and with the metering screws 28. As is best shown in FIGS. 1–3, the cartoning carousel 17 basically comprises an upper frame 22, a cam rail structure horizontally revolving about vertical drive/idler shaft and sprocket assemblies 24*a* and *b* and with active and return sides 25*a* and *b*, the active side 25 a having downwardly and upwardly sloping sections 26*a* and *b*, and carton holders 23 which are vertically moveable with respect to the cam rail structure via cam following slide bearing sleeves coupled to vertically disposed shafts 30 attached to the cam rail structure. The carton holders 23 have a vacuum based grasping mechanism and a predetermined configuration for receiving cartons 13 from the placer 18, holding the cartons 13, and depositing the cartons 13 onto the bottle groups 12. The carton holders 23 move longitudinally and are synchronized with the movement of the bottle groups 12 traveling longitudinally directly below on the conveyor 15. On the active side 25, the carton holders 23 move downwardly in section 26*a* to bring cartons 13 into engagement with bottle groups 12. Subsequently, the carton holders move upwardly in section 26*b* away from the merged group 12 and carton 13. Subsequently, the carton holders 23 are conveyed along the return side 25*b* to the infeed end of the active side 25*a*.

Referring again to FIGS. 4–7, at the infeed section 16, unspaced input bottles 12 traveling on the conveyor 15 are laterally stabilized by the guide rails 30. In a normal processing mode, the rotating starwheels 27 travel at a predetermined speed which is slower than the speed of the conveyor 15. Bottles are engaged by the starwheels 27 one at a time and are slowed with respect to upstream bottles. Upon release from the starwheels, the speed of the bottles is increased by the conveyor 15. This imparts a spacing between the bottles 12 leaving the starwheels 27 and moving toward the metering screws 28, and decreases the surge pressure (normally present due to the volume of bottles 12 located upstream of the apparatus 10) on such bottles 12. High surge pressure has a deleterious effect on the function of the metering screws 28. As the metering screws 28 are driven at the same speed as the starwheels 27, bottles 12 which are adjacent the input end of the metering screws become unspaced and contact one another, via the action of the conveyor 15 operating at its predetermined speed through the predetermined distance between the starwheels 27 and the metering screws 28, to enable proper grouping by the metering screws 28. Also in the normal processing mode, groups 11 output from the metering screws 28 are synchronized with the carton holders 23 of the cartoning carousel 17 for cartoning.

The configuration of the metering screw 28 requires that it be in a particular position relative to a group of unspaced cans at its infeed end to function properly. This position is referred to a "home position." The home position varies depending upon the particular screw design, but each screw has its own determinable home position where the first bottle or article engaged is properly grouped with successive bottles to form a complete group of the desired size, and no partial groups are formed. Because the operation of the conveyor 15, starwheels 27, metering screws 28 and cartoning carousel 17 are synchronized, the apparatus will continue to run in a coordinated fashion after the metering screw 28 is initially set in a home position and primed with a charge or supply of cans at its infeed end.

The auto-priming system operates at the start-up phase of operation of the apparatus 10 to provide automatic synchronization of apparatus 10 mechanisms and priming of complete article groups. As was previously mentioned, apparatus 10 start-up occurs periodically for routine maintenance, product or packaging change over. The auto-priming system enables faster start-up of the machine 10 than would otherwise be possible with prior art manual start-up techniques.

The auto-prime system coordination of apparatus 10 mechanisms is preferably implemented via software. Alternatively, control of the mechanisms may be implemented by hard wired circuitry. At start-up, the conveyor 15, starwheels 27 and metering screws 28 are stationary. An apparatus 10 operator initially performs a visual inspection of the apparatus 10 to verify that there are no bottles 12 on the conveyor 15 between the starwheels 27 and the metering screws 28 and that there are no bottles engaged or touching the starwheels 27. Additionally the operator may perform a general reset of the machine control circuitry. The operator initiates the prime from the control panel 41 by signaling a machine prime mode. The prime mode signal first actuates the bottle stops 29 as will be described further below. Secondly, the starwheels 27 and metering screws 28 rotate to the home position. In the home position, the starwheels 27 position a receiving member or cup to accept and hold a bottle from the conveyor 15. As the conveyor 15 has not yet moved, no bottles are yet engaged by the starwheels 27. Next, the operator signals a prime infeed which actuates the conveyor to run or jog a predetermined distance at a slow speed to bring one bottle into engagement with the home positioned cup of each starwheel 27. At this point the operator may again visually inspect the apparatus 10 to verify bottle position. Next, the operator signals an auto-prime start which causes counters to start and the starwheels 27 and metering screws 28 to rotate. Also the conveyor 15 operates at a jog speed and bottles come through towards the metering screws 28. At this point the forward motion of the bottles 12 is impeded, a predetermined distance just before the metering screws 28, by the actuated bottle stops 29. After the starwheels 27 have rotated a predetermined rotational distance as determined by a counter activated upon auto-prime signaling, the bottle stops 29 deactivate and allow the bottles to pass into the metering screws 28. In this example, approximately two six packs of bottles pass the starwheels 27 before the bottle stops 29 deactivate. This process of halting the forward motion of the bottles 12 at a predetermined point and for a predetermined time properly aligns the infed bottles with the metering screws 28. Simultaneously with the actuation of the starwheels 27 and the metering screws 28, the cartoning carousel 17 operates to align cartons 13 with the bottle groups 11. Preferably, the operator terminates the auto-prime mode after approximately 6–8 cartons 13 are filled with bottles by signaling a stop auto-prime. Subsequently, the operator signals a machine start and the apparatus 10 runs at full speed.

Figure 8:
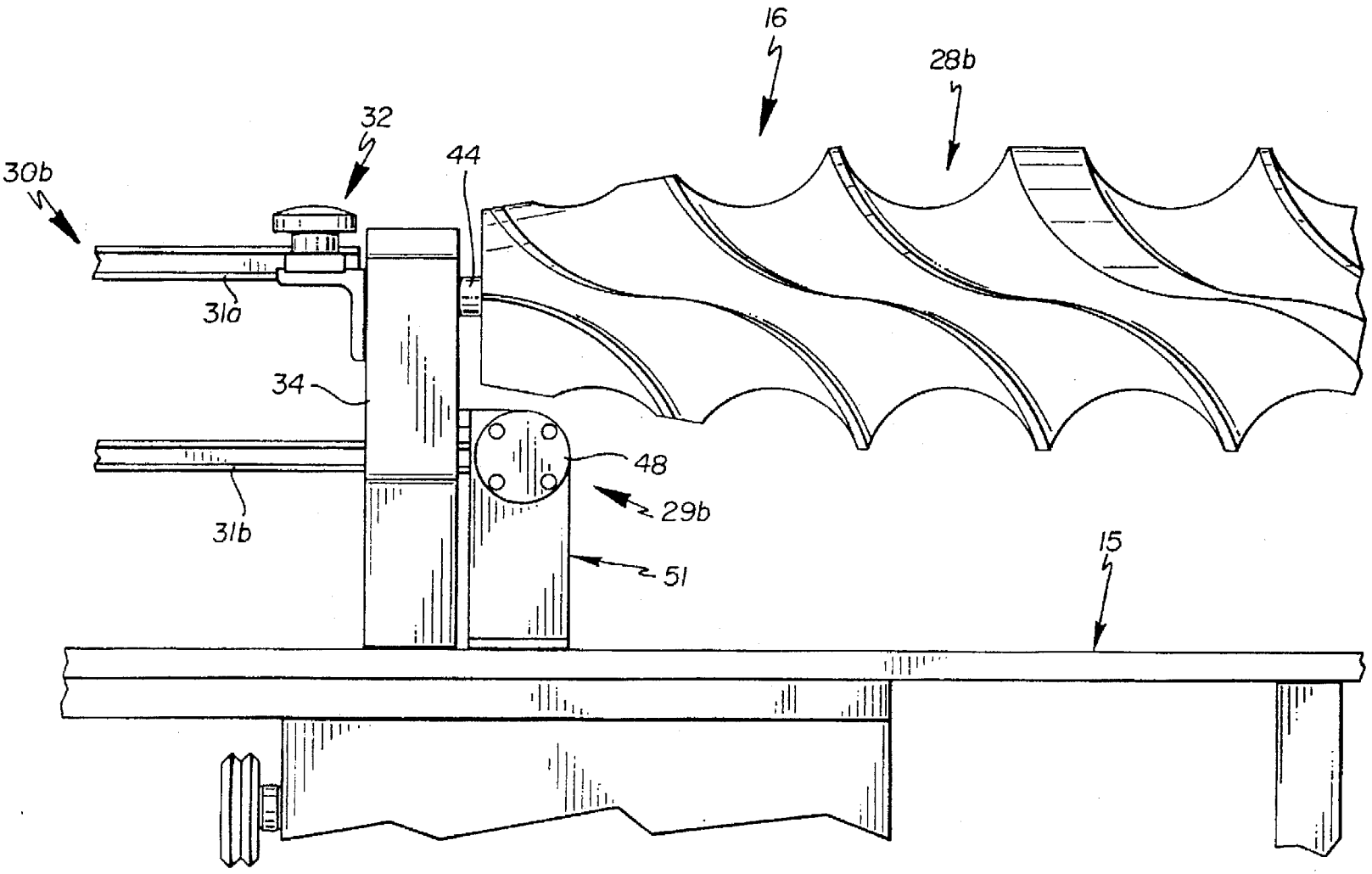
FIG. 8 is a side view of a portion of the infeed section shown in FIG. 4.
Figure 9:
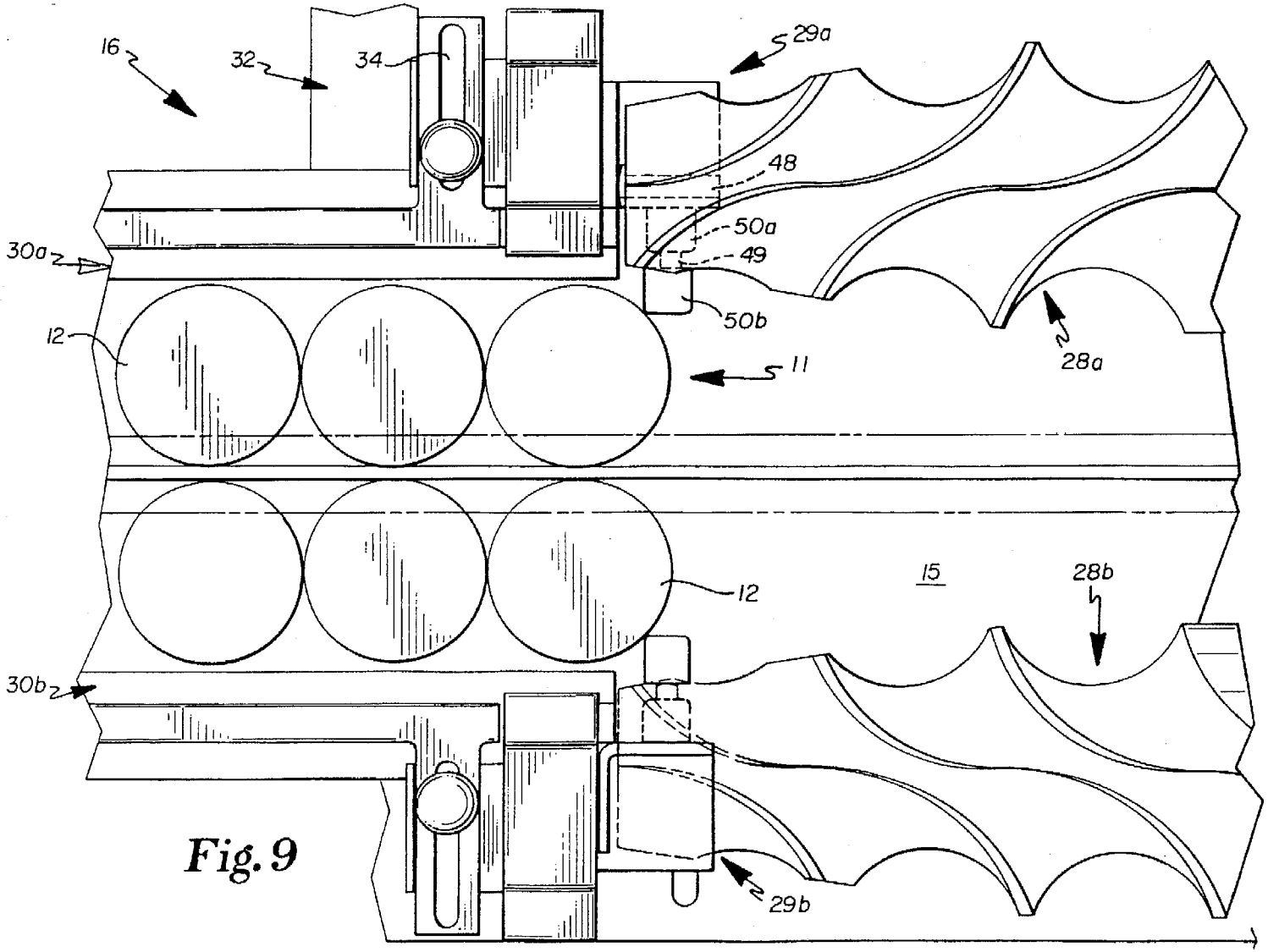
FIG. 9 is a top view of the infeed section portion shown in FIG. 8.
Figure 10:
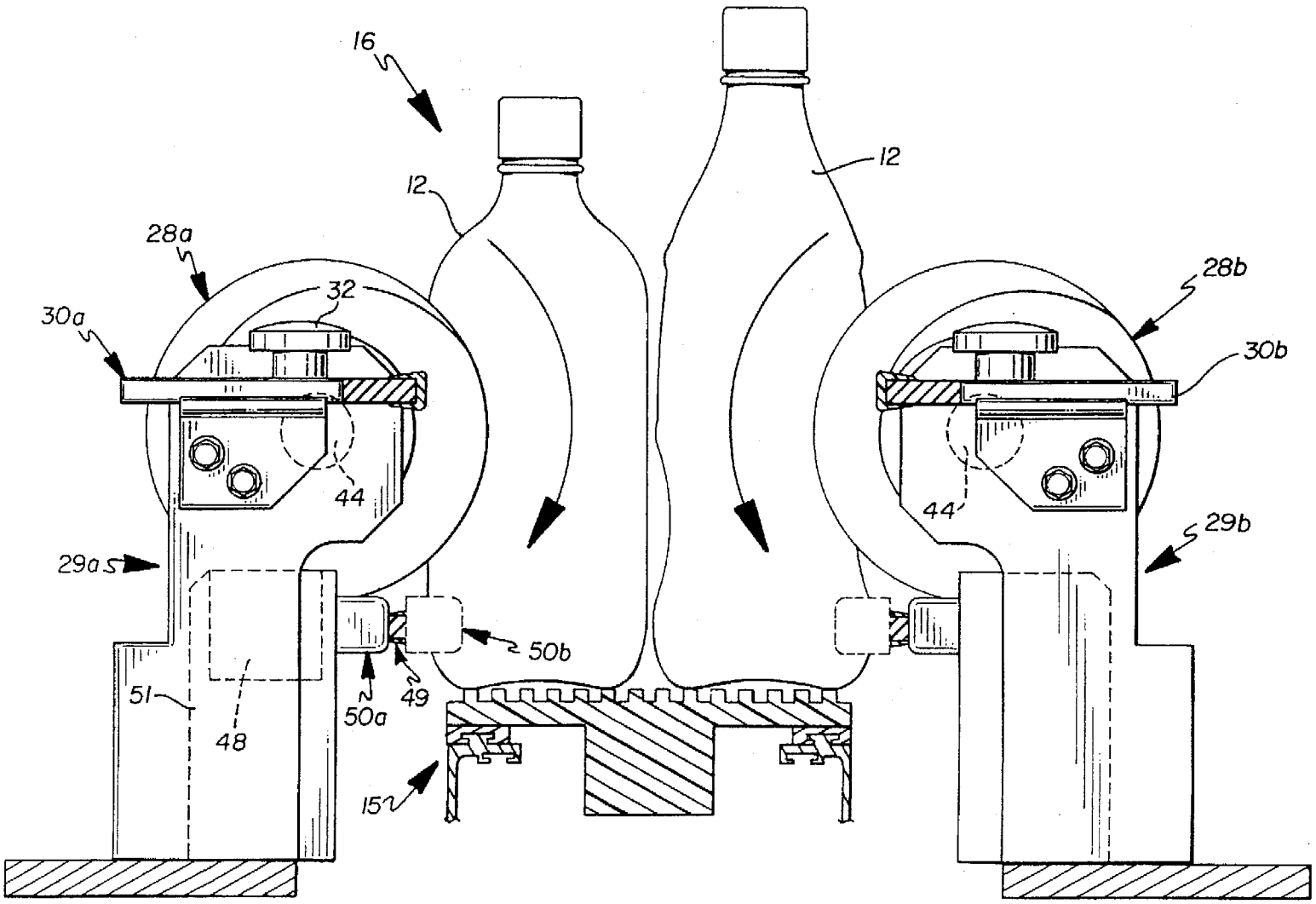
FIG. 10 is an end view, taken from the left side of FIG. 8, of the infeed section portion.

Referring also to FIGS. 8–10, each stop mechanism 29 basically comprises an air cylinder 48 with an extensible shaft 49 and a stop end 50 (50*a* is retracted position and 50*b* is an extended or actuated position). The cylinder 48 is adjustably mounted to a bracket 51. The shaft 49 is extendible horizontally outwardly from the cylinder 48 in response to air pressure therein. Air lines (not shown) are connected to each air cylinder 48 and are communicatively connected to a pneumatic control mechanism which controls the actuation of the air cylinders. Although the actuators 29 are shown in this example to be pneumatically controlled, electrically or mechanically controlled actuators may be substituted consistent with the basic teachings of the invention. The actuators 29 are disposed below the infeed end of the metering screws 28.

The descriptions above and the accompanying drawings should be interpreted in the illustrative and not the limited sense. While the invention has been disclosed in connection with the preferred embodiment or embodiments thereof, it should be understood that there may be other embodiments which fall within the spirit and scope of the invention as defined by the following claims. Where a claim is expressed as a means or step for performing a specified function it is intended that such claim be construed to cover the corresponding structure, material, or acts described in the specification and equivalents thereof, including both structural equivalents and equivalent structures.

The invention claimed is:

1. An automatic priming packaging apparatus, comprising:

(a) at least one article conveyor having a plurality of article conveyance lanes;

(b) an article grouping mechanism constructed and arranged to meter articles moving in said conveyance lanes into predetermined groups, said article grouping mechanism including at least one metering screw and at least one starwheel selector;

(c) at least one pair of aligned, cylindrical stop posts oriented for extension into each said conveyance lane over said conveyor, said stop posts further being disposed between said at least one starwheel selector and said at least one metering screw, said stop posts further being separate from said article grouping mechanism;

(d) means to actuate said stop posts, whereby said stop posts are extendible and retractable in said article conveyance lane, said stop posts physically blocking and always stopping travel of articles in said lanes when extended and permitting travel of articles in said lanes when retracted;

(e) means to coordinate actuation of said means to actuate and said article grouping mechanism, wherein said means to coordinate controls travel of articles during a startup phase and properly aligns articles with said at least one metering screw, said means to coordinate including the steps of:

(1) beginning an autoprime mode by initializing a counter and rotating said at least one starwheel selector and said at least one metering screw, wherein articles move past said at least one starwheel selector toward said at least one metering screw;

(2) actuating said stop posts to temporarily impede the articles for a predetermined time and at a predetermined distance from said at least one metering screw;

(3) deactivating said stop posts after said at least one starwheel selector rotates a predetermined distance as determined by said counter, whereby said articles pass into said at least one metering screw; and (4) terminating said autoprime mode and beginning a machine start, wherein said packaging apparatus runs at full speed; and (f) means to package article groups.

* * * * *